US009027777B1

(12) United States Patent
Steidinger, III

(10) Patent No.: US 9,027,777 B1
(45) Date of Patent: May 12, 2015

(54) VENTED TRASH CONTAINER WITH A MANIFOLD OF AIR CHANNELS

(76) Inventor: John H. Steidinger, III, Bethlehem, PA (US)

( * ) Notice: Subject to any disclaimer, the term of this patent is extended or adjusted under 35 U.S.C. 154(b) by 665 days.

(21) Appl. No.: 12/564,316

(22) Filed: Sep. 22, 2009

(51) Int. Cl.
*B65D 1/06* (2006.01)

(52) U.S. Cl.
CPC ..... *B65D 1/06* (2013.01); *Y10S 220/908* (2013.01)

(58) Field of Classification Search
CPC ..... B65F 1/068; B65F 1/06
USPC ..... 220/495.04, 675, 608, 908
See application file for complete search history.

(56) References Cited

U.S. PATENT DOCUMENTS

| | | | | |
|---|---|---|---|---|
| 2,995,269 | A * | 8/1961 | Pease | 220/787 |
| 3,659,741 | A * | 5/1972 | Corelli | 220/592.01 |
| 3,815,778 | A | 6/1974 | Martin | |
| 4,125,187 | A * | 11/1978 | Vecchiotti | 429/176 |
| 4,245,685 | A * | 1/1981 | Nemitz et al. | 220/780 |
| 4,294,379 | A | 10/1981 | Bard | |
| 4,715,572 | A | 12/1987 | Robbins, III et al. | |
| 4,890,760 | A | 1/1990 | Nicoll, Sr. et al. | |
| 5,170,906 | A | 12/1992 | Kochelek | |
| 5,265,755 | A | 11/1993 | McArther, Jr. et al. | |
| 5,269,434 | A | 12/1993 | Labuda | |
| 5,375,732 | A | 12/1994 | Bowers et al. | |
| 5,388,717 | A | 2/1995 | LeVasseur | |
| 5,390,818 | A | 2/1995 | LaBuda | |
| 5,492,241 | A | 2/1996 | Barnett et al. | |
| 5,690,247 | A | 11/1997 | Boover | |
| D398,117 | S | 9/1998 | Giba | |
| 5,803,303 | A | 9/1998 | Timm et al. | |
| 6,000,571 | A | 12/1999 | Brooks et al. | |
| 6,015,063 | A | 1/2000 | Poliquin | |
| 6,149,053 | A * | 11/2000 | Chatterton et al. | 229/407 |
| 6,223,927 | B1 | 5/2001 | Rand | |
| 6,471,221 | B1 | 10/2002 | McGarry | |
| 6,474,495 | B1 | 11/2002 | Frei | |
| 6,554,151 | B1 | 4/2003 | Brennan | |
| 6,594,876 | B1 | 7/2003 | Stastny | |
| 6,634,518 | B1 | 10/2003 | Jones | |
| D490,581 | S | 5/2004 | Keithly et al. | |
| 6,736,281 | B2 | 5/2004 | Joseph | |
| 7,438,199 | B1 | 10/2008 | Tidrick | |
| 2007/0068947 | A1 | 3/2007 | Rush | |
| 2008/0083756 | A1 | 4/2008 | Daniels | |
| 2009/0095755 | A1 | 4/2009 | McCurry | |
| 2009/0179034 | A1 | 7/2009 | Olson | |
| 2009/0188921 | A1 | 7/2009 | Ball | |
| 2009/0194539 | A1 | 8/2009 | Williams | |

* cited by examiner

*Primary Examiner* — Stephen Castellano
(74) *Attorney, Agent, or Firm* — Clinton H. Wilkinson; Charles A. Wilkinson

(57) ABSTRACT

A vented trash container with a manifold of air channels which is capable of distributing air throughout the entire container. The vented trash container is capable of eliminating vacuum between walls of the container and a liner. The manifold in the container comprises a plurality of air channels and an air distributing means. The manifold forms a network of the air channels so as to provide air distribution throughout the entire container and enhance reliability of the air distribution. The vented trash container with the manifold can be cast form a single piece of a material to form an integrated seamless unit and easily manufactured by a single injection molding process.

12 Claims, 8 Drawing Sheets

VENTED TRASH CONTAINER WITH A MANIFOLD OF AIR CHANNELS

BACKGROUND OF THE INVENTION

1. Field of the Invention

The present invention relates to a vented trash container with a manifold of air channels for air distribution throughout the entire container. The vented trash container is capable of eliminating vacuum between walls of the container and a plastic liner.

Removal of a liner from a trash container is difficult due to a vacuum condition between walls of the container and the liner. The vacuum condition is created when the liner is placed into the container and filled. Generally, the container has a bottom and at least one side wall; thus, the vacuum condition does not only exist between the liner and the side wall but also between the liner and the bottom. The vacuum condition may cause rupture of the liner when the filled liner is lifted from the container. In addition, due to the vacuum condition, the liner can not be easily placed into the container. It is desired that the vacuum condition in the container is eliminated or prevented.

2. Related Art

In some disclosures, vent apertures or openings are built in a trash can or receptacle. In U.S. Pat. No. 3,815,778 (Martin, 1974), a trash bag retainer includes a plurality of apertures along the side walls from the open top to the bottom of the retainer. In U.S. Pat. No. 4,890,760 (Nicoll, Sr. et al., 1990), a trash receptacle has air holes on the bottom, and the holes extend from the outside to the inside of the receptacle. In U.S. Pat. No. 5,265,755 (McArther, Jr. et al., 1993), a vent stalk is built on the bottom of a trash receptacle, and holes and channels on the vent stalk allow air ingress and egress between outside and inside of the receptacle. In U.S. Pat. Nos. 5,269,434 and 5,390,818 (Labuda, 1993 and 1995), at least one aperture with a valve is built near the bottom of a receptacle, and the aperture is used to communicate the interior and the exterior of the receptacle. In U.S. Pat. No. 5,388,717 (LeVasseur, 1995), a vented trash can has air allowing components on the sidewalls near the bottom of the trash can, and the air allowing components are openings which allow air to enter the trash can. In U.S. Pat. No. 5,690,247 (Boover, 1997), a plurality of apertures is formed on side walls adjacent to the bottom of a wastebasket to facilitate the removal of a trash liner. In U.S. Pat. No. 5,803,303 (Timm et al., 1998), a waste basket has an arched member forming a cavity at the bottom, and holes located along the apex of the arched member are designed to reduce vacuum. In U.S. Pat. No. 6,223,927 B1 (Rand, 2001), vent slots or holes are built on sidewalls and the bottom of a container, and the vent slots or holes allow air to circulate between the inside and the outside of the container. In U.S. Pat. No. 6,471,221 B1 (McGarry, 2002), small holes or apertures are built on the bottom of a trash can for the purpose of abating the creation of suction. In U.S. Pat. No. 6,474,495 B1 (Frei, 2002), apertures are located proximal to the open top and the bottom of a garbage can. In U.S. Pat. No. 6,554,151 B1 (Brennan, 2003), a waste receptacle has an opening near the bottom to allow for the ingress of air into the receptacle. In U.S. Pat. No. D490,581 S (Keithly et al., 2004), a vent is attached to the outside surface of a side wall of a trash can, and the vent has openings communicating the interior and the exterior of the trash can. In US Pat. Pub. No. 2009/0188921 A1 (Ball, 2009), the outer and inner surfaces of a container have several vent openings to allow air to enter and exit the container. In US Pat. Pub. No. 2009/0194539 A1 (Williams, 2009), a vent opening with a valve is built at the bottom wall of a trash receptacle. The vent apertures or openings presented in the above-mentioned disclosures have the following disadvantages. (1) The vent apertures or openings destroy a seamless system of a container; thus, smell will be emitted from the container, leakage will be discharged outside the container, and insects will enter the container through the vent apertures or openings. (2) The vent apertures or openings can be easily blocked by a flexible liner. (3) The locally positioned apertures or openings can not eliminate and prevent the vacuum condition throughout an entire container.

In some disclosures, one or more air conduits are built on side walls of a trash can or receptacle. In U.S. Pat. No. 4,294,379 (Bard, 1981), a plurality of hollow tubes is attached to the interior of side walls, or molded into side walls. In U.S. Pat. No. 5,375,732 (Bowers et al., 1994), an air conduit is integrally mounted to the sidewall of a garbage can, and openings located on walls of the air conduit communicate the interior of the garbage can and the air conduit. Various air conduits attached on side walls are disclosed in U.S. Pat. No. 5,492,241 (Barnett et al., 1996), U.S. Pat. No. 6,015,063 (Poliquin, 2000), US Pat. Pub. No. 2007/0068947 A1 (Rush, 2007), 2009/0095755 A1 (McCurry, 2009), and 2009/0179034 A1 (Olson, 2009). In some disclosures, an air conduit is extended to the bottom of a container. In U.S. Pat. No. 6,594,876 B1 (Stastny, 2003), one end of an air conduit is extruded outside of the trash can and tied onto the trash can, and the other end placed on the bottom of the trash can. In U.S. Pat. No. 6,634,518 B1 (Jones, 2003), a tubular conduit is disposed between walls of a waste receptacle and a liner, one portion of the conduit is positioned on a sidewall and the other portion on the bottom of the waste receptacle, and a plurality of holes is located in the portion on the bottom. In US Pat. Pub. No. 2008/0083756 A1 (Daniels, 2008), a lined waste receptacle has a vertical air conduit on a side wall and a horizontal air conduit on the bottom, and the air conduit on the bottom is connected to a block holder with apertures. The air conduits presented in the above-mentioned disclosures have the following disadvantages. (1) The air conduits can not prevent vacuum in most contacting areas between a liner and walls of a container; in other words, the air conduits can not prevent vacuum in an entire container. (2) The openings, the holes, or the apertures on walls of the air conduits can be easily blocked by a flexible liner.

In some disclosures, for the purpose of eliminating or preventing the vacuum condition in a container, an inner wall and an outer wall are built in the container, the space between the inner wall and the outer wall is used as an air conduit, and openings are built on the walls at locations of the top and the bottom of the container. The double-wall structure is presented in U.S. Pat. No. 6,000,571 (Brooks et al., 1999) and U.S. Pat. No. 7,438,199 B1 (Tidrick, 2008). The double-wall structure has the same disadvantages as the air conduits mentioned in the last paragraph. An additional disadvantage of the double-wall structure is that the complexity of the double-wall structure makes the manufacture of the container more complicated and difficult.

A disclosure in U.S. Pat. No. 6,736,281 B2 (Joseph, 2004) presents a vacuum release waste receptacle. In the receptacle, a plurality of air baffles is built on the surfaces of side walls and the bottom, projecting inwardly into the interior of the receptacle. Air channels are formed by the air baffles, the side walls or the bottom, and a liner. A disclosure in U.S. Pat. No. 5,170,906 (Kochelek, 1992) presents a trash container with vertical ribs which are either attached to side walls of the container by adhesive strips or molded into side walls. A disadvantage in these two disclosures is that the intrusive air baffles and ribs will wear and breach a flexible liner. In addition, blockage of the air channels by a flexible liner will occur provided two adjacent air baffles are not close to each other.

In U.S. Pat. No. 4,715,572 (Robbins, III et al., 1987) and U.S. Pat. No. D398,117 (Giba, 1998), air conduits are formed by outward recessed side walls in a container. The air conduits are only located on side walls, and no air conduits are built on the bottom of the container. Therefore, the air conduits can not eliminate or prevent the vacuum condition in the entire container, especially on the bottom of the container. Most importantly, the air conduits are not networked and they are independent to each other. As a result, the air conduits can not distribute air throughout the container provided any of the air conduits is blocked locally.

SUMMARY

An object of the present invention is to provide a vented trash container with a manifold of air channels, which is capable of eliminating vacuum throughout the entire container and also enhancing reliability of air distribution. The vented trash container has at least one side wall, a bottom, an open top, and a manifold of air channels. The manifold comprises a plurality of essentially vertical air channels on the at least one side wall, a plurality of essentially horizontal air channels on the bottom, and an air distributing means located essentially at the center of the bottom. The manifold constructs a network of the air channels and thus provides air distribution throughout the entire container. The manifold also provides reliability of the air distribution through the network of the air channels. If the air channels are locally blocked, the network is capable of maintaining the air distribution throughout the entire container.

Another object of the present invention is to provide a vented trash container which has an integrated seamless structure and can be easily manufactured. The air channels and the air distributing means are defined by recessed segments of the at least one side wall and the bottom of the container. Therefore, the at least one side wall, the bottom, the air channels, and the air distributing means are capable of being cast from a single piece of a material to form an integrated seamless unit. Due to the structural simplicity, the vented trash container in the present invention is easy to be manufactured by a single injection molding process.

DESCRIPTION OF THE PREFERRED EMBODIMENTS

Figure 1:
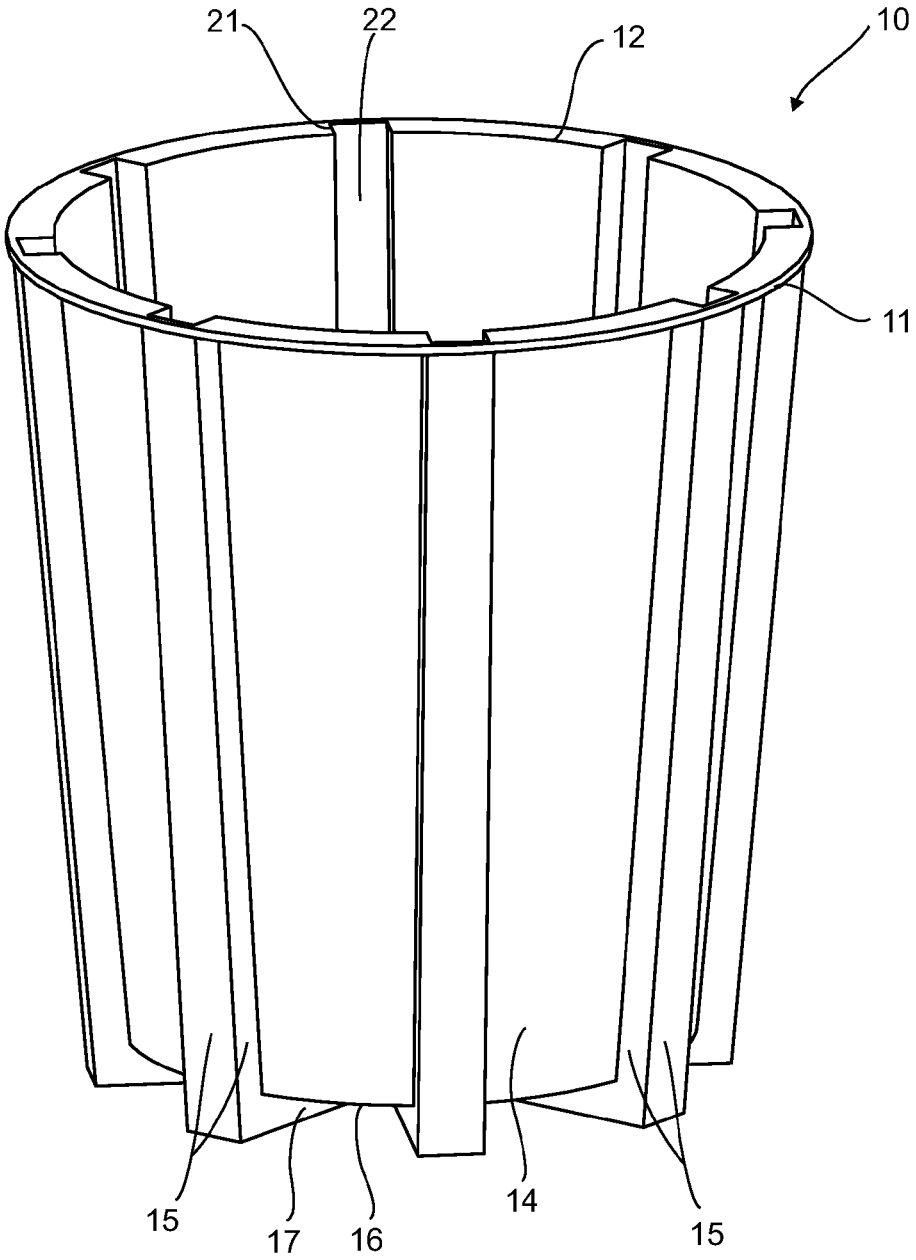
FIG. 1 is a perspective side view of a round shaped container.
Figure 2:
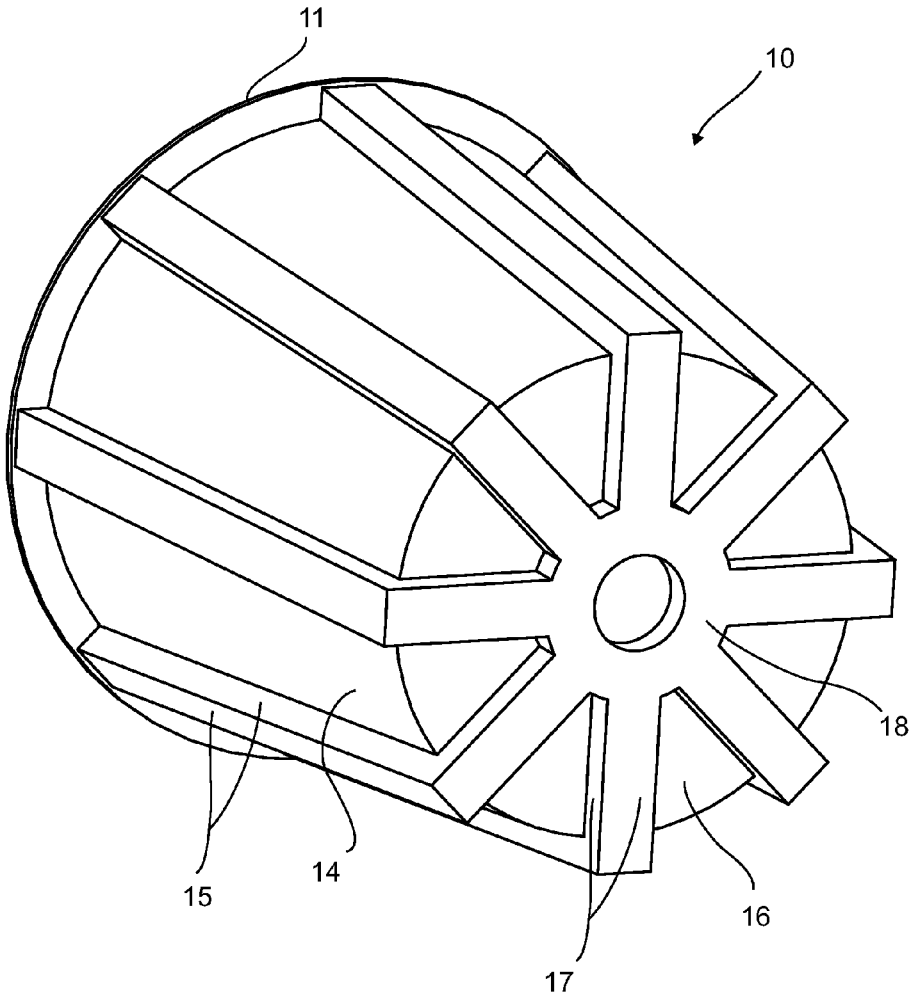
FIG. 2 is a perspective bottom view of a round shaped container.
Figure 3:
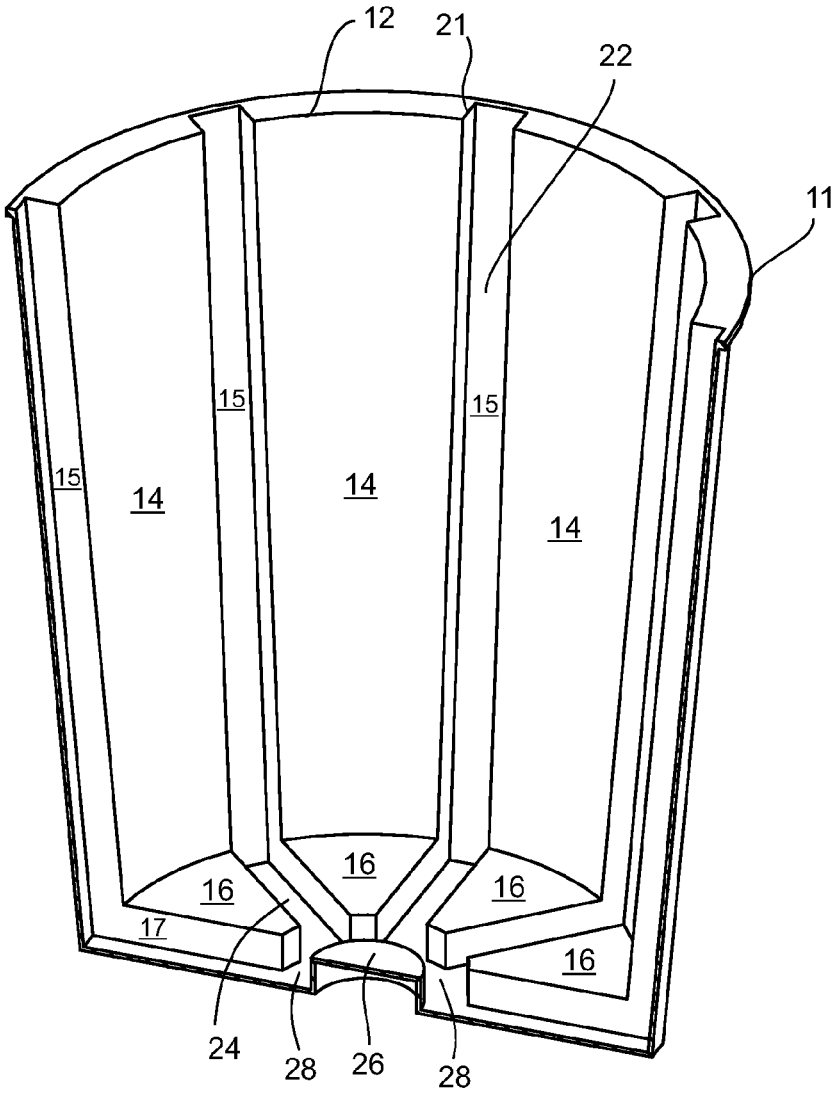
FIG. 3 is a perspective vertical sectional view, showing the interior of a round shaped container.
Figure 4:
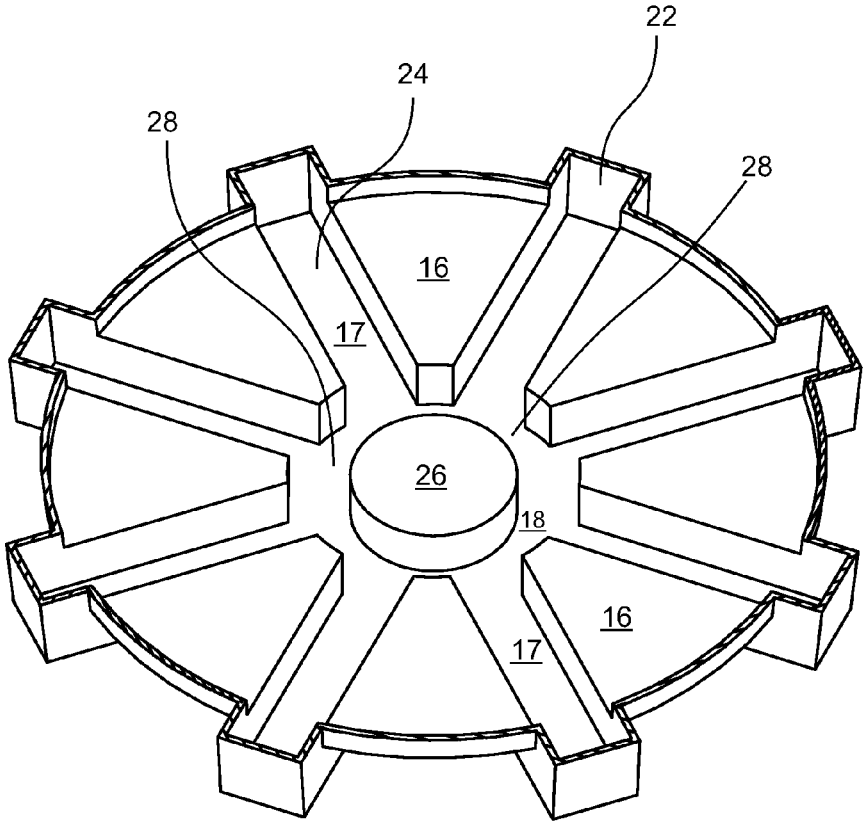
FIG. 4 is a perspective horizontal sectional view, showing the bottom of a round-shaped container.

An exemplary embodiment of a vented trash container 10 with a manifold of air channels is shown in FIGS. 1-4. The vented trash container 10 has a circular open top 12, a circular bottom 16, and a side wall 14 raised from the bottom 16. In the vented trash container 10, the manifold of air channels comprises a plurality of substantially vertical air channels 22 on the side wall 14, a plurality of substantially horizontal air channels 24 on the bottom 16, and an air distributing means located substantially at the center of the bottom 16. The air distributing means comprises a circularly looping channel 28 around a raised circular central piece 26. The raised circular central piece 26 is substantially coplanar with the bottom 16. The circularly looping channel 28 is defined by a recessed segment 18 of the bottom 16. The segment 18 is recessed downward away from the interior of the container 10. The circularly looping channel 28 is open toward the interior of the container 10 and has a laterally cross-sectional shape of a rectangle. The circularly looping channel 28 links all the horizontal air channels 24, so that the horizontal air channels 24 communicate to each other through the circularly looping channel 28. The circularly looping channel 28 links all the horizontal air channels 24 and further all the vertical air channels 22; therefore, a network of the air channels is formed. The horizontal air channels 24 are positioned longitudinally along radial directions from the air distributing means on the bottom 16. Each of the horizontal air channels 24 is defined by a recessed segment 17 of the bottom 16. The segment 17 is recessed downward away from the interior of the container 10. The horizontal air channels 24 are open toward the interior of the container 10 and have laterally cross-sectional shapes of rectangles. One longitudinal open end of each of the horizontal air channels 24 connects to the circularly looping channel 28, and the other longitudinal open end of each of the horizontal air channels 24 connects to the lower longitudinal open end of each of the vertical air channels 22. Each of the vertical air channels 22 is defined by a recessed segment 15 of the side wall 14 and has a laterally cross-sectional shape of a rectangle. The segment 15 is recessed outward away from the interior of the container 10. Each of the vertical air channels 22 has a longitudinal side opened toward the interior of the container 10. While the lower longitudinal open end of each of the vertical air channels 22 is located proximal to the bottom 16, the upper longitudinal open end 21 is located proximal to the open top 12. The upper longitudinal open end 21 of each of the vertical air channels 22 communicates the exterior and the interior of the container 10. An annular flange 11 is built around the open top 12.

Figure 5:
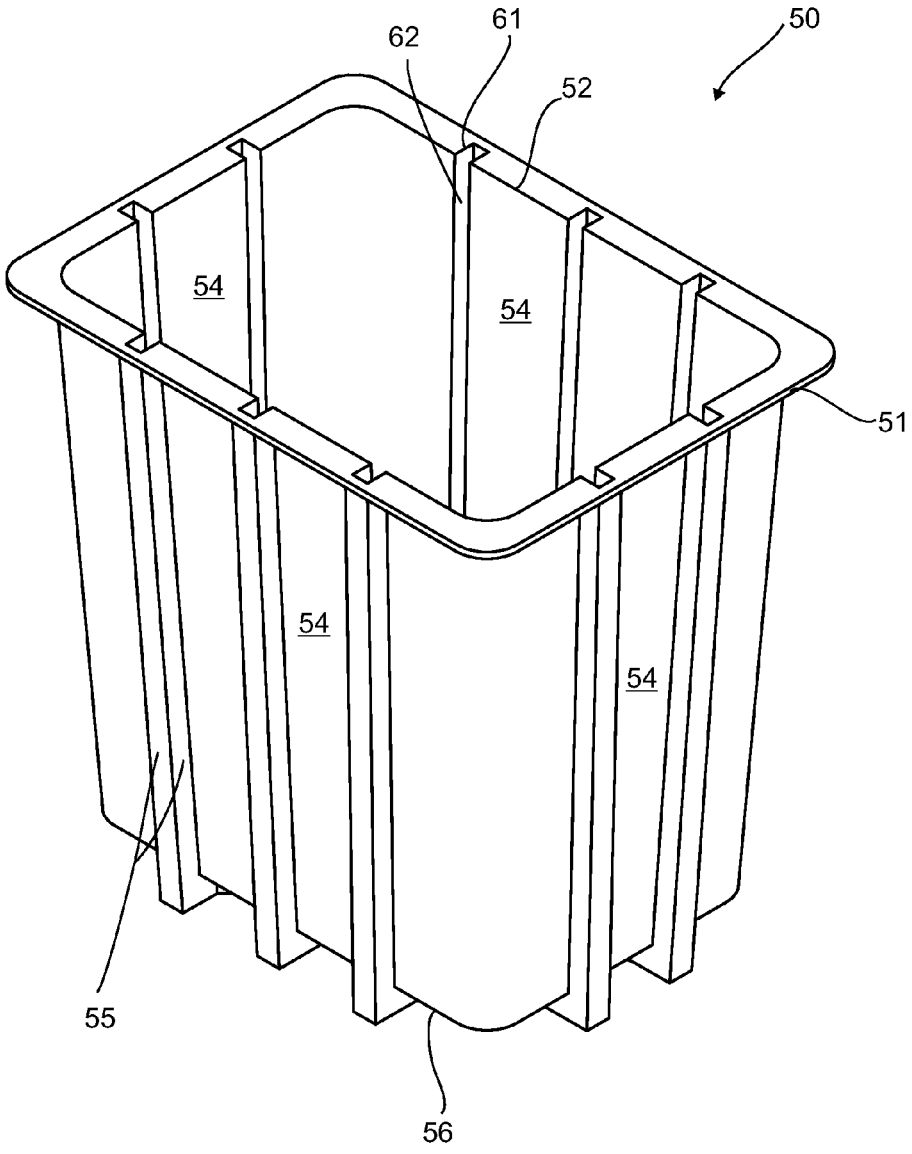
FIG. 5 is a perspective side view of a rectangle shaped container.
Figure 6:
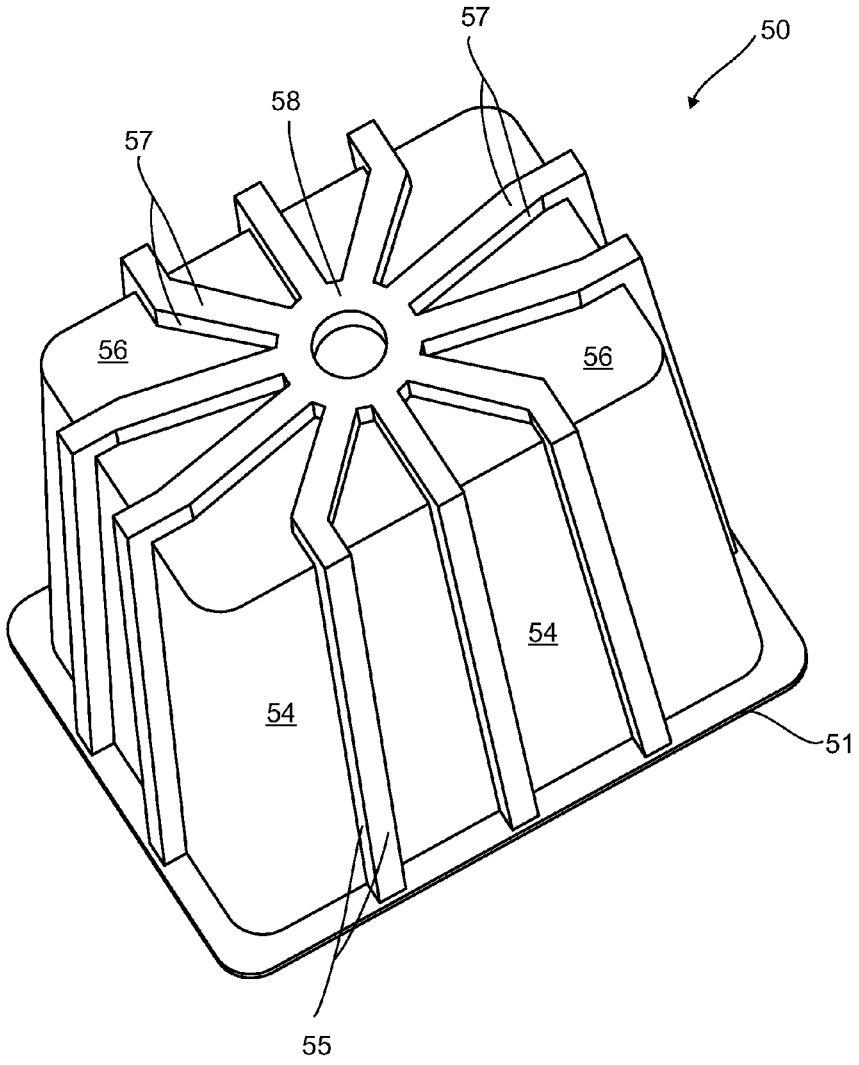
FIG. 6 is a perspective bottom view of a rectangle shaped container.
Figure 7:
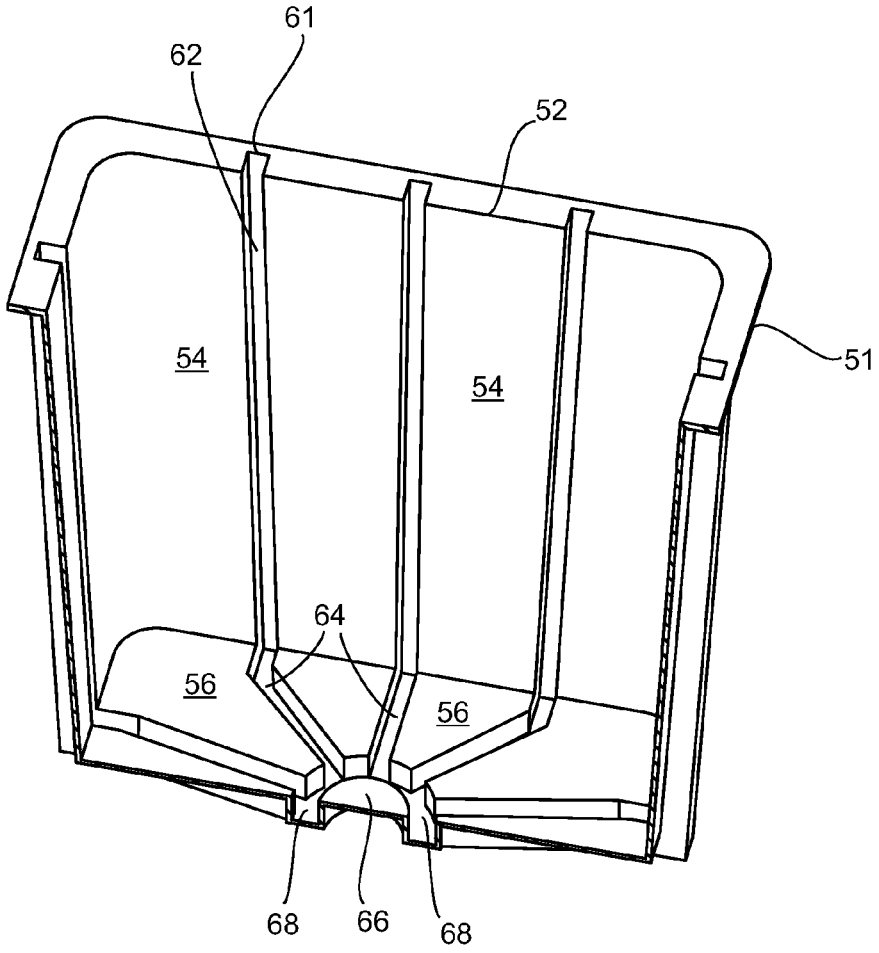
FIG. 7 is a perspective vertical sectional view, showing the interior of a rectangle shaped container.
Figure 8:
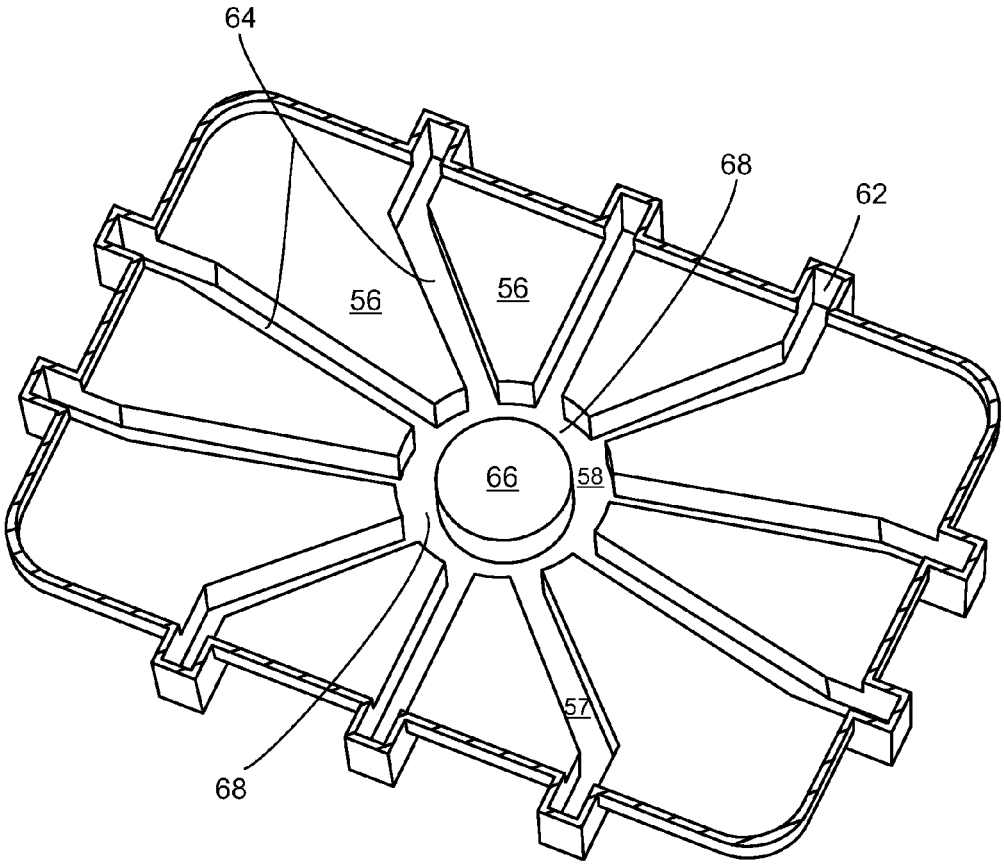
FIG. 8 is a perspective horizontal sectional view, showing the bottom of a rectangle shaped container.

FIGS. 5-8 show another exemplary embodiment of a vented trash container 50 with a manifold of air channels. The vented trash container 50 has substantially a shape of a rectangular box. The vented trash container 50 comprises a rectangular open top 52, a rectangular bottom 56, and four side walls 54 raised from the bottom 56. Around the open top 52, the container 50 has an annular flange 51. The manifold of air channels comprises a plurality of substantially vertical air channels 62, a plurality of substantially horizontal air channels 64, and a circularly looping channel 68 around a raised circular central piece 66. The combination of the circularly looping channel 68 and the raised circular central piece 66 is an air distributing means located substantially at the center of the bottom 56. The circularly looping channel 68 is defined by recessing a segment 58 of the bottom 56 downward away from the interior of the container 50. The circularly looping channel 68 is open toward the interior of the container 50. The circularly looping channel 68 links all the horizontal air channels 64 and further all the vertical air channels 62; therefore, a network of the air channels is formed. The horizontal air channels 64 are positioned along radial directions from the air distributing means. Each of the horizontal air channels 64 is defined by recessing a segment 57 of the bottom 56 downward away from the interior of the container 50. Each of the horizontal air channels 64 has a longitudinal side opened toward the interior of the container 50. While one longitudinal open end of each of the horizontal air channels 64 connects to the circularly looping channel 68 of the air distributing means, the other longitudinal open end connects to the lower longitudinal open end of each of the vertical air channel 62. Each of the vertical air channels 62 is defined by recessing a segment 55 of the side walls 54 outward away from the interior of the container 50. Each of the vertical air channels 62 has a longitudinal side opened toward the interior of the container 50. While each of the vertical air channels 62 has one lower longitudinal open end located proximal to the bottom 56, each of the vertical air channels 62 has one upper longitudinal open end 61 located proximal to the open top 52. The upper longitudinal open end 61 communicates the exterior and the interior of the container 50.

In other embodiments, a vented trash container comprises an air distributing means which is an open chamber located substantially at the center of the bottom of the container. The open chamber is defined by recessing a segment of the bottom downward away from the interior of the container. The open chamber links a plurality of substantially horizontal air channels on the bottom, so that the horizontal channels communicate to each other through the open chamber.

In other embodiments, a vented trash container may have an open top with a shape other than a circle or a rectangle. The shape of the open top may also be an ellipse, a square, a triangle, a trapezoid, or a polygon.

In other embodiments, a vented trash container may have a bottom with a shape other than a circle or a rectangle. The shape of the bottom may also be an ellipse, a square, a triangle, a trapezoid, or a polygon.

In other embodiments, the horizontal air channels, the vertical air channels, and the looping channel may have a laterally sectional shape other than a rectangle. The laterally sectional shapes of the channels may also be a semicircle, a semi-ellipse, a square, a triangle, or a polygon.

In other embodiments, the raised central piece may be other than circular. The raised central piece may also be elliptical, rectangular, squared, triangular, trapezoidal, or polygonal.

In other embodiments, the looping channel is around the raised central piece in an ellipse, a rectangle, a square, a triangle, a trapezoid, or a polygon.

Although the present invention has been described in considerable detail with clear and concise language and with reference to certain preferred versions thereof including the best mode anticipated by the inventor, other versions are possible. Therefore, the spirit and scope of the invention should not be limited by the description of the preferred versions contained therein, but rather by the claims appended hereto.

What is claimed is:

1. A vented trash container comprising:

a bottom, at least one side wall raised from said bottom, and an open top;

a manifold of air channels for air distribution comprising a plurality of substantially vertical air channels positioned on said at least one side wall, a plurality of substantially horizontal air channels positioned on said bottom, and an air distributing means located substantially at the center of said bottom;

each of said vertical air channels on each of said at least one side wall being spaced apart at regular intervals with respect to adjacent vertical air channels on said at least one side wall and being defined by recessing a segment of said at least one side wall outward away from the interior of said container, having a longitudinal side opened toward the interior of said container, having a first longitudinal open end located proximal to said open top, having a second longitudinal open end located proximal to said bottom;

each of said horizontal air channels being defined by recessing a segment of said bottom downward away from the interior of said container, having a longitudinal side opened toward the interior of said container, being longitudinally positioned along a substantially radial direction from said air distributing means, having a third longitudinal open end connecting to a respective one of said second longitudinal open ends, and having a fourth longitudinal open end connecting to said air distributing means, said horizontal air channels being substantially uniform in width; and said air distributing means comprising a looping channel around a raised central piece, said raised central piece being of a uniform height and substantially coplanar with said bottom, said looping channel being defined by recessing a segment of said bottom downward away from the interior of said container, said looping channel opened toward the interior of said container, said looping channel being substantially uniform in width, said horizontal air channels communicating to each other through said looping channel.

2. The vented trash container of claim 1, wherein said open top has a shape of a circle, an ellipse, a rectangle, a square, a triangle, a trapezoid, or a polygon.

3. The vented trash container of claim 1, wherein said bottom has a shape of a circle, an ellipse, a rectangle, a square, a triangle, a trapezoid, or a polygon.

4. The vented trash container of claim 1, wherein each of said vertical air channels has a laterally sectional shape of a semicircle, a semi-ellipse, a rectangle, a square, a triangle, a trapezoid, or a polygon.

5. The vented trash container of claim 1, wherein each of said horizontal air channels has a laterally sectional shape of a semicircle, a semi-ellipse, a rectangle, a square, a triangle, a trapezoid, or a polygon.

6. The vented trash container of claim 1, wherein said looping channel has a laterally sectional shape of a semicircle, a semi-ellipse, a rectangle, a square, a triangle, a trapezoid, or a polygon.

7. The vented trash container of claim 1, wherein said looping channel is around said raised central piece in a circle, an ellipse, a rectangle, a square, a triangle, a trapezoid, or a polygon.

8. The vented trash container of claim 1, wherein said raised central piece has a top view shape of a circle, an ellipse, a rectangle, a square, a triangle, a trapezoid, or a polygon.

9. The vented trash container of claim 1, wherein the width of the horizontal air channels and looping channel is constant.

10. A linable vented trash container comprising:

a bottom, at least one side wall raised from said bottom, and an open top;

a network of air channels for preventing a vacuum condition from occurring between a liner placed in said container and the bottom or at least one side wall of said container comprising a plurality of substantially vertical air channels positioned on said at least one side wall, a plurality of substantially horizontal air channels positioned on said bottom, and an air distribution nexus located substantially at the center of said bottom;

each of said vertical air channels being symmetrically spaced from a midpoint of said at least one side wall and spaced from adjacent vertical air channels on each of said at least one side wall at regular intervals, and being defined by recessing a segment of said at least one side wall outward away from the interior of said container, having a longitudinal side opened toward the interior of said container, having a first longitudinal open end located proximal to said open top, and having a second longitudinal open end located proximal to said bottom;

each of said horizontal air channels being defined by recessing a segment of said bottom downward away from the interior of said container, having a longitudinal side opened toward the interior of said container, being longitudinally positioned along a substantially radial direction from said air distribution nexus, having a third longitudinal open end connecting to a respective one of said second longitudinal open ends, and having a fourth longitudinal open end connecting to said air distribution nexus; and said air distribution nexus comprising a looping channel defined by a chamber and a raised unchanneled central piece, said chamber having a uniform width and being defined by recessing a segment of said bottom downward away from the interior of said container and said chamber being opened toward the interior of said container, said raised piece being positioned substantially at the center of said chamber.

11. The trash container of claim 10 in which the width of said looping channel and of said horizontal channels is constant.

12. The trash container of claim 11 in which the dimensions of said vertical channels is constant.

* * * * *